US011527373B2

(12) United States Patent
Stevelink et al.

(10) Patent No.: US 11,527,373 B2
(45) Date of Patent: Dec. 13, 2022

(54) ACTUATING MECHANISM FOR AN ELECTRICAL SWITCHING DEVICE PROVIDING PREDICTABLE SWITCHING SPEED

(71) Applicant: Eaton Intelligent Power Limited, Dublin (IE)

(72) Inventors: Frans Stevelink, Weerselo (NL); Gerard Schoonenberg, Hengelo (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/573,653

(22) Filed: Jan. 12, 2022

(65) Prior Publication Data

US 2022/0223360 A1 Jul. 14, 2022

(30) Foreign Application Priority Data

Jan. 14, 2021 (GB) ..... 2100455

(51) Int. Cl.
*H01H 21/36* (2006.01)
*H01H 21/04* (2006.01)
*H01H 21/22* (2006.01)

(52) U.S. Cl.
CPC ..... *H01H 21/36* (2013.01); *H01H 21/04* (2013.01); *H01H 21/22* (2013.01)

(58) Field of Classification Search
CPC ..... H01H 21/36; H01H 21/04; H01H 21/22; H01H 3/3031; H01H 3/30; H01H 3/04
USPC .. 200/43.01, 43.1, 43.16, 43.19, 43.21, 400, 200/401, 500, 318, 320–322, 329, 332, 200/335, 337, 553
See application file for complete search history.

(56) References Cited

U.S. PATENT DOCUMENTS 4,798,922 A 1/1989 Roberts
8,569,637 B2 * 10/2013 Byeon ..... H01H 3/3015 200/5 B

* cited by examiner

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

An actuating mechanism for an electrical switching device includes a frame and a driving member. The driving member is rotatably arranged in the frame around an axis and is movable between a first driver position and a second driver position. The driving member is mechanically linkable to the electrical switching device by a first linking member. The movable contacts of the electrical switching device are in a first position in the first driver position of the driving member and are in a second position in the second driver position of the driving member. The actuating mechanism further includes an actuating member. The actuating member is rotatably arranged in the frame around an axis and is movable between a first actuator position and a second actuator position by hand or based on using a motor. The actuating mechanism further includes a load spring.

10 Claims, 6 Drawing Sheets

ACTUATING MECHANISM FOR AN ELECTRICAL SWITCHING DEVICE PROVIDING PREDICTABLE SWITCHING SPEED

CROSS-REFERENCE TO PRIOR APPLICATION

Priority is claimed to British Patent Application No. GB 2100455.1, filed on Jan. 14, 2021, the entire disclosure of which is hereby incorporated by reference herein.

FIELD

The invention relates to an actuating mechanism for an electrical switching device, e.g. a circuit breaker, a load break switch, a contactor, etc. which comprises a frame, a driving member, an actuating member, a load spring, a first locking member and a second locking member. Moreover, the invention relates to an arrangement, with an electric switching device and an actuating mechanism of the above kind, wherein the driving member is linked to the electric switching device by means of a first linking member.

BACKGROUND

An actuating mechanism and an arrangement of the type above are generally known in prior art. However, a drawback of numerous prior art solutions is that the switching speed or in more detail the transition speed of the switching state of the electrical switching device from "on" to "off" and/or from "off" to "on" depends on the speed of the movement of the actuating member and thus is not repeatable. In other words, the switching speed depends on how fast a motor for operating the actuating mechanism or an operator moves. This may lead to problems in view of electrical switching devices that should be switched at a defined minimum switching speed.

SUMMARY

In an embodiment, the present invention provides an actuating mechanism for an electrical switching device, comprising: a frame, a driving member, which is rotatably arranged in the frame around an axis and which is movable between a first driver position and a second driver position, wherein the driving member is mechanically linkable to the electrical switching device by a first linking member, wherein movable contacts of the electrical switching device are in a first position in the first driver position of the driving member and are in a second position in the second driver position of the driving member, an actuating member, which is rotatably arranged in the frame around an axis and which is movable between a first actuator position and a second actuator position by hand or by a motor, load spring, which at its first end is mounted to a first mounting point on the driving member and mounted to a second mounting point on the actuating member, wherein the first mounting point is spaced apart from the axis of the driving member, and wherein the second mounting point is spaced apart from the axis of the actuating member, first locking member and a second locking member, which are mounted to the frame, each being movable between a locking position and a release position, wherein in a first final state, the driving member is in its first driver position and the actuating member is its first actuator position and locked by the first locking member, which is in its locking position, wherein in a second final state the driving member is in its second driver position and the actuating member is its second actuator position and locked by the second locking member, which is in its locking position, wherein during a transition from the first final state to the second final state, the load spring is loaded upon a movement of the actuating member towards its second position, wherein the driving member is held in its first position by the first locking member and wherein the first locking member is moved into its release position by the actuating member before or when the actuating member reaches its second position, wherein the driving member, caused by the force generated by the load spring, moves into its second position when the first locking member moves into its release position, and wherein the second locking member is moved into its locking position before or when the driving member reaches its second position.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
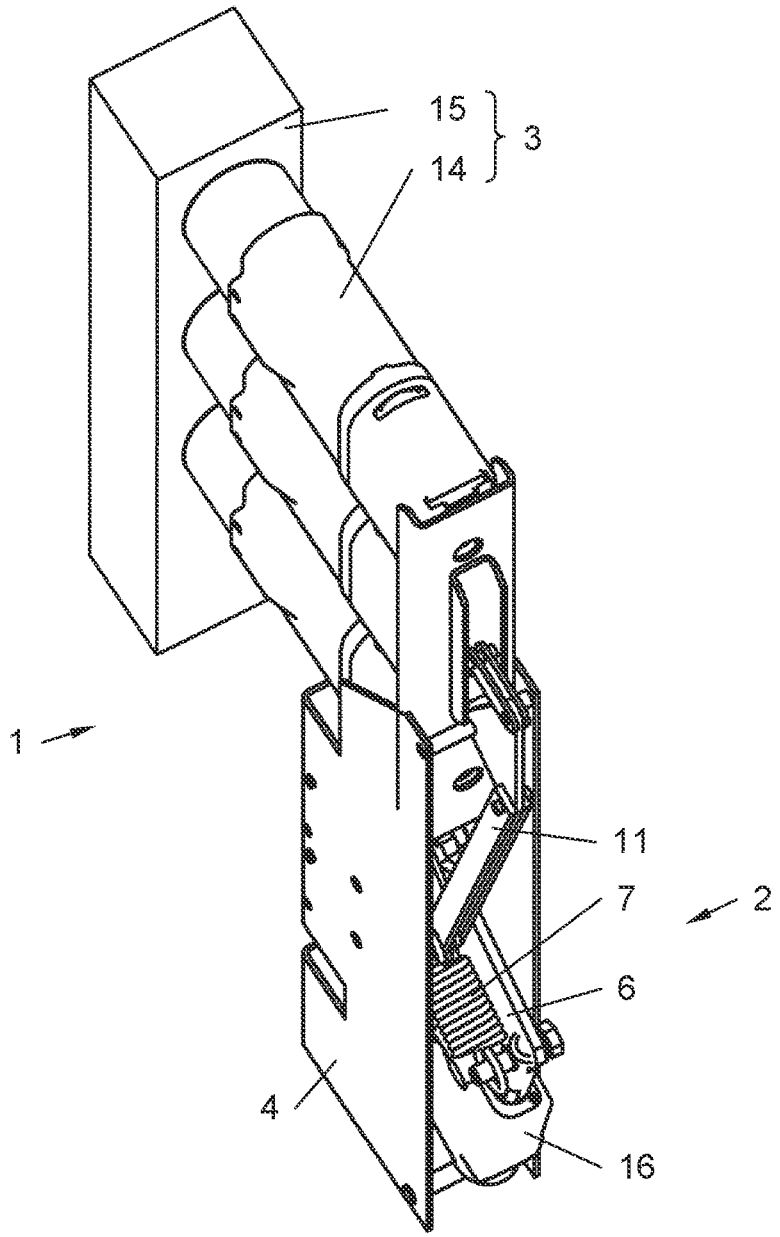
FIG. 1 shows an oblique view of an arrangement with an actuating mechanism and an electrical switching device coupled thereto.

In some embodiments, of the present invention provides an improved actuating mechanism and an improved arrangement with such an actuating mechanism. In particular, a predefined switching speed for the electric switching device may be ensured, independent of how fast a motor for operating the actuating mechanism or an operator moves.

The present invention provides an actuating mechanism as disclosed in the opening paragraph, which comprises:

a frame, a driving member which is rotatably arranged in the frame around an axis and which is movable between a first driver position and a second driver position, wherein the driving member is prepared to get mechanically linked to the electrical switching device by a first linking member wherein movable switching contacts of the electrical switching device are in a first position in the first driver position of the driving member and are in a second position in the second driver position of the driving member, an actuating member which is rotatably arranged in the frame around an axis and which is movable between a first actuator position and a second actuator position by hand or by means of a motor, a load spring, which at its first end is mounted to a first mounting point on the driving member and mounted to a second mounting point on the actuating member, wherein the first mounting point is spaced apart from the axis of the driving member and wherein the second mounting point is spaced apart from the axis of the actuating member, a first locking member and a second locking member which are mounted to the frame each being movable between a locking position and a release position, wherein in a first final state the driving member is in its first driver position and the actuating member is its first actuator position and locked by the first locking member, which is in its locking position, wherein in a second final state the driving member is in its second driver position and the actuating member is its second actuator position and locked by the second locking member, which is in its locking position, wherein during a transition from the first final state to the second final state the load spring is loaded upon a movement of the actuating member towards its second position, wherein the driving member is held in its first position by the first locking member and wherein the first locking member is moved into its release position by the actuating member before or when the actuating member reaches its second position, wherein the driving member, caused by the force generated by the load spring, moves into its second position when the first locking member moves into its release position and wherein the second locking member is moved into its locking position before or when the driving member reaches its second position.

In some embodiments, the present invention provides an arrangement as disclosed in the opening paragraph, which comprises an electric switching device and an actuating mechanism of the above kind, wherein the driving member is linked to the electric switching device by means of a first linking member.

The first position of the (movable) switching contacts of the electrical switching device can be linked to an "on" state of the electrical switching device, and the second position of the (movable) switching contacts of the electrical switching device can be linked to an "off" state of the electrical switching device or vice versa.

The arrangement can comprise a motor linked to the actuating member of the actuating mechanism by means of a second linking member. The arrangement can also comprise a hand lever, which is connected to the actuating member of the actuating mechanism or which is part of the actuating member.

By use of the actuating mechanism, the transition speed of the switching state of the electrical switching device from "on" to "off" or from "off" to "on" is independent of the speed of the movement of the actuating member and independent of a particular moving profile of the actuating member. In particular, the amount of mechanical energy stored in the load spring is independent of a particular moving speed or a particular moving profile of the actuating member. That is why the way of how the electric switching device is switched is repeatable. It does not matter if the motor for operating the actuating mechanism moves fast or slow, and it does not matter if an operator manually moves the actuating member fast or slow. It does even not matter if the actuating member is moved back and forth between its first and second position.

For example, the electrical switching device can be embodied as a circuit breaker, a load break switch, a contactor, etc. In particular, the invention relates to three-pole medium voltage switching devices and more particularly to systems in a voltage range of 12-15 kV. Nonetheless, the inventive measures can be applied to other voltage systems and to single or double pole switching devices as well.

It should be noted that the load spring may equally be termed as "charge spring" throughout the patent application. So, both terms may synonymously be used. As mentioned hereinbefore, said spring is loaded or charged with mechanical energy by a movement of the actuating member.

Beneficially, during a transition from the second final state to the first final state the load spring is loaded upon a movement of the actuating member towards its first position, wherein the driving member is held in its second position by the second locking member and wherein the second locking member is moved into its release position by the actuating member before or when the actuating member reaches its first position, wherein the driving member, caused by the force generated by the load spring, moves into its first position when the second locking member moves into its release position and wherein the first locking member is moved into its locking position before or when the driving member reaches its first position.

In turn, the transition speed during the opposite transition of the switching state is predictable as well. So, in total, the transition speed of the switching state of the electrical switching device from "on" to "off" and from "off" to "on" is independent of the speed of the movement of the actuating member and thus repeatable. It does not matter if the motor for operating the actuating mechanism moves fast or slow, and it does not matter if an operator manually moves the actuating member fast or slow.

Beneficially, the load spring is embodied as a tension spring. In that way, there is no need for a guiding for the spring. However, the load spring can also be embodied as a compression spring. Other elastic elements are usable as well for storing the mechanical energy for the switching transition.

Beneficially, the first and the second locking member are rotatable mounted to the frame and forced into their locking position by a first locking spring coupled to the first locking member and a second locking spring coupled to the second locking member or by a single locking spring coupled to the first locking member and the second locking member.

In that way, the actuating mechanism is particularly reliable because of the swiveling movement of the locking members.

Alternatively, it is also of advantage if the first and the second locking member are slidably mounted to the frame and forced into their locking position by a first locking spring coupled to the first locking member and a second locking spring coupled to the second locking member or by a single locking spring coupled to the first locking member and the second locking member.

In that way, the actuating mechanism can be made more compact.

Beneficially, the driving member, the actuating member and the first and the second locking member are symmetrically arranged around a symmetry line running through the axis of the driving member and a center point in the middle of the first and the second driver position. In this way, the same behavior of the actuating mechanism can be achieved for the switching "on" operation and the switching "off" operation.

Finally, it is of advantage, if the axis of the driving member coincides with the actuator axis of the actuating member. Hence, the actuating mechanism can be designed compact.

Generally, same parts or similar parts are denoted with the same/similar names and reference signs. The features disclosed in the description apply to parts with the same/similar names respectively reference signs. Indicating the orientation and relative position (up, down, sideward, etc.) is related to the associated figure, and indication of the orientation and/or relative position has to be amended in different figures accordingly as the case may be.

Figure 2:
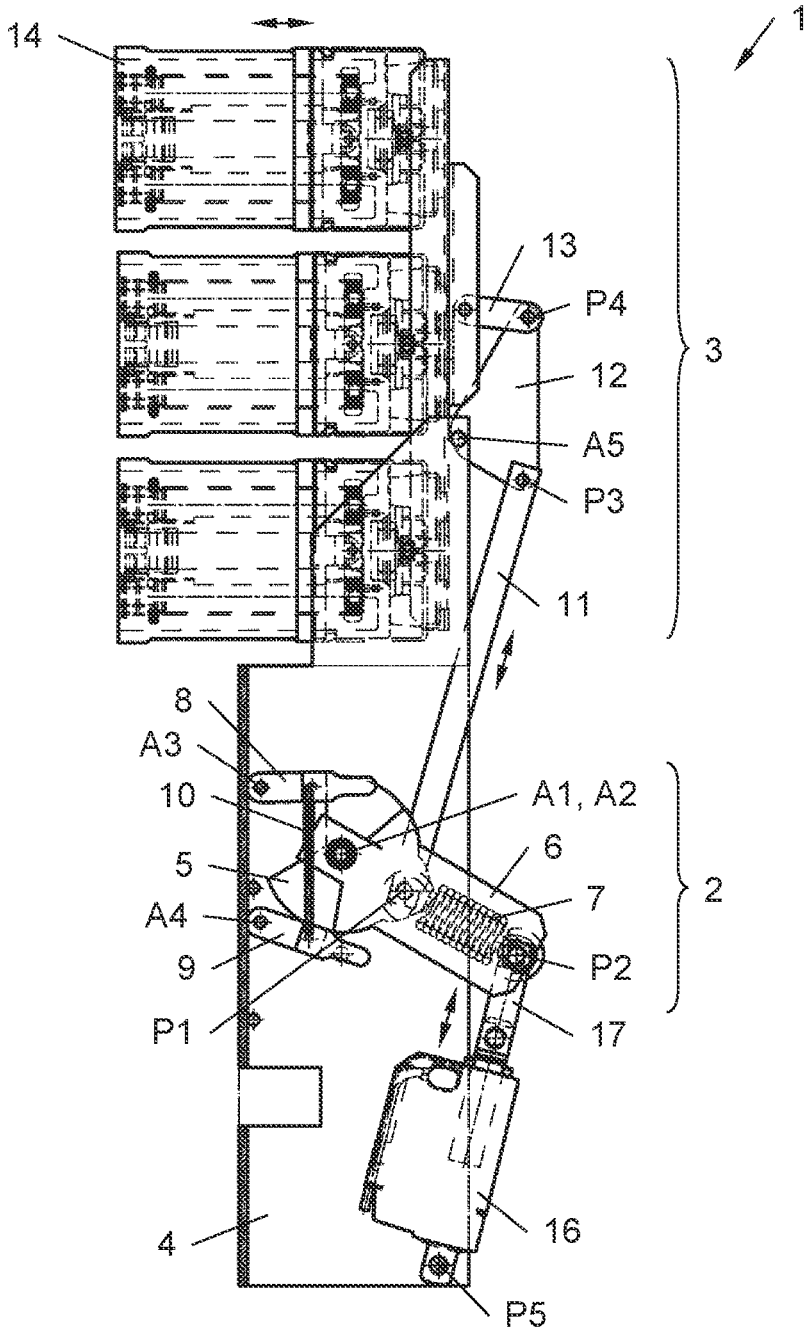
FIG. 2 shows a side view and partial cross sectional view of the arrangement of FIG. 1.

FIGS. 1 and 2 show an arrangement 1 with an actuating mechanism 2 and an electrical switching device 3 coupled thereto. FIG. 1 shows the arrangement 1 in oblique view, and FIG. 2 shows the arrangement 1 in side view and partial cross sectional view. The actuating mechanism 2 comprises a frame 4, a driving member 5 an actuating member 6, a load spring 7, a first locking member 8 and a second locking member 9.

Figure 3:
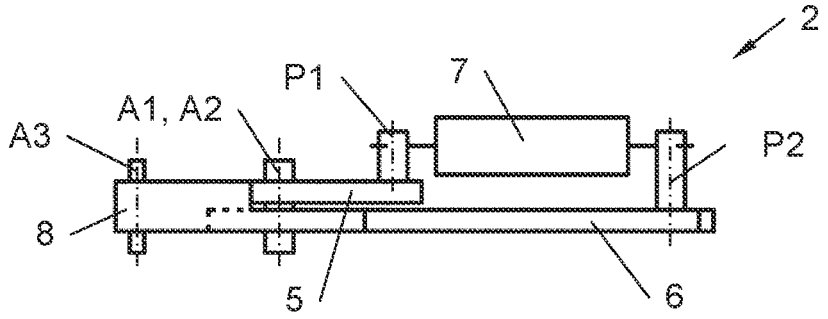
FIG. 3 shows a side view of the actuating mechanism detached from the rest of the arrangement of FIG. 1.
Figure 4:
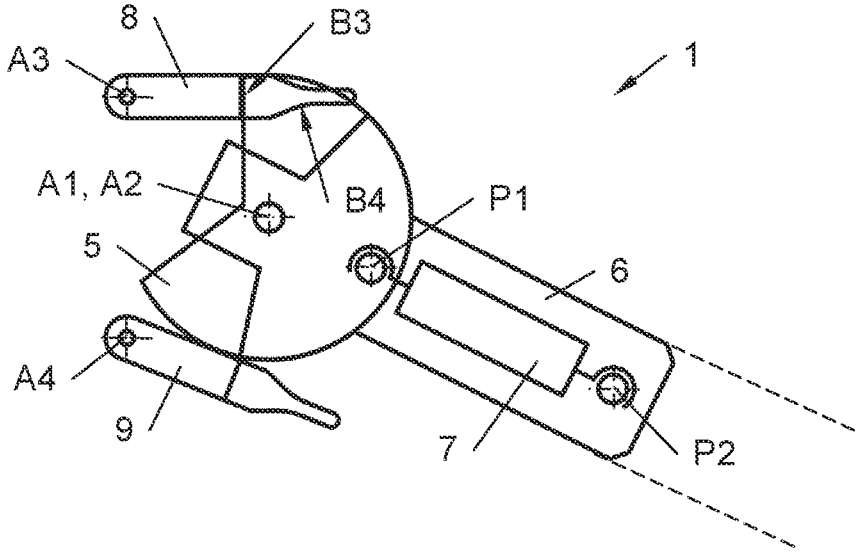
FIG. 4 shows a top view of the actuating mechanism of FIG. 3.
Figure 5:
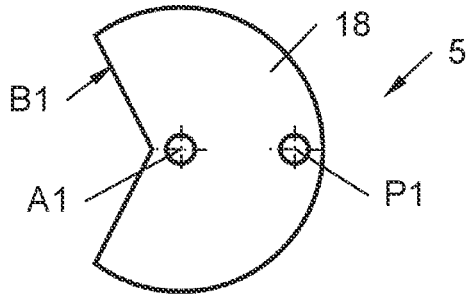
FIG. 5 shows a top view of the driving member.
Figure 6:
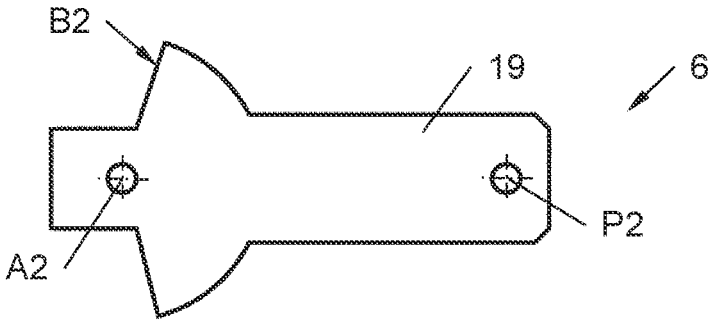
FIG. 6 shows a top view of the actuating member.
Figure 7:
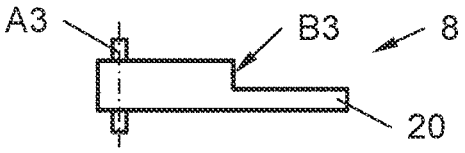
FIG. 7 shows a side view of the first locking member.
Figure 8:
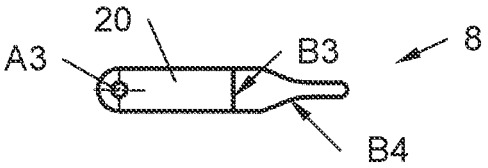
FIG. 8 shows a top view of the first locking member.

FIGS. 3 and 4 show the actuating mechanism 2 detached from the rest of the arrangement 1. FIG. 3 shows the actuating mechanism 2 in side view, FIG. 4 in top view. Further on, FIGS. 5 to 8 show some parts of the actuating mechanism 2 detached from the rest of the actuating mechanism 2. In detail, FIG. 5 shows a top view of the driving member 5, FIG. 6 shows a top view of the actuating member 6, FIG. 7 shows a side view of the first locking member 8, and FIG. 8 shows a top view of the first locking member 8.

It should be noted, that for a better understanding of the actuating mechanism 2, the driving member 5 and the actuating member 6 are considered to be made of a transparent material in FIG. 4 and also in FIGS. 9 to 16. However, this is no mandatory condition for the real actuating mechanism 2, and of course, the driving member 5 and the actuating member 6 can be made of an opaque material in reality.

The arrangement 1 is now explained in more detail:

The driving member 5 is rotatably arranged in the frame 4 around an axis A1 and is movable between a first driver position and a second driver position. In FIGS. 1 to 4, the driving member 5 is shown in its first driver position, but see also FIGS. 9 to 15 for the second driver position. The actuating member 6 is rotatably arranged in the frame 4 around an axis A2 and is movable between a first actuator position and a second actuator position. In FIGS. 1 to 4, the actuating member 6 is shown in its first actuator position, but see also FIGS. 9 to 15 for the second actuator position. The load spring 7 is mounted to a first mounting point P1 on the driving member 5 at its first end and mounted to a second mounting point P2 on the actuating member 6 at its second end. The first mounting point P1 is spaced apart from the axis A1 of the driving member 5, and the second mounting point P2 is spaced apart from the axis A2 of the actuating member 6. Further on, the first locking member 8 and the second locking member 9 are rotatably mounted to the frame 4 so that each of them is independently movable between a locking position and a release position. In detail, the first locking member 8 is rotatably mounted to the frame 4 around an axis A3, and the second locking member 9 is rotatably mounted to the frame 4 around an axis A4. In FIGS. 1 to 4, the first locking member 8 is shown in its locking position and the second locking member 9 is shown in its release position, but again see also FIGS. 9 to 15 for other positions. The first locking member 8 and the second locking member 9 are forced into their locking positions by a single locking spring 10 in this example, which is coupled to the first locking member 8 and the second locking member 9.

The driving member 5 is mechanically linked to the electric switching device 3 by means of a first linking member 11, which is embodied as a rod in this example. In detail, the first linking member 11 is pivotally mounted to the first mounting point P1 on the driving member 5 at its first end and pivotally mounted to a third mounting point P3 on a transmission element 12 at its second end. The transmission element 12 is rotatably arranged in the frame 4 around an axis A5. In addition, a push rod 13 is pivotally mounted to the fourth mounting point P4 on the transmission element 12 at its first end and connected to a movable switching member 14 at its second end. It should be noted, that the electrical switching device 3 comprises the (linearly) movable switching member 14 and a static switching member 15 in this example, wherein FIG. 2 just shows the movable switching member 14. The electrical switching device 3 has three poles in this example. In detail, the movable switching member 14 basically form a switching cap here, which contains an U-shape conductor with two movable switching contacts at the ends of the "U". Instead of an U-shape with two movable switching contacts, also a single movable switching contact could be used in combination with a wire strand or other flexible connection or in combination with a slide contact to form a current loop. However, other contact arrangements and pole arrangements are possible as well.

Finally, the arrangement 1 comprises a motor 16, which is pivotally mounted to a fifth mounting point P5 in the frame 4 at its first end and mechanically linked to the actuating member 6 of the actuating mechanism 2 by means of a second linking member 17. In detail, the second linking member 17 is embodied as a rod and pivotally connected to the second mounting point P2 on the actuating member 6.

It should be noted that the motor 16 is a linear motor in the example of FIGS. 1 and 2, but a rotational motor 16 could be used as well. Alternatively or in addition, the actuating member 6 can be operated by hand, meaning manually by an operator. So, on the one hand, in particular the electrical switching device 3 can be operated even in case of malfunction of the motor 16. On the other hand, if just manual operation is wanted, a motor 16 can even be omitted. To reduce the force for moving the actuating member 6, a hand lever can be attached to the actuating member 6 or can be part of the actuating member 6 as this is indicated by dashed lines in FIG. 4. It is also possible that the hand lever can attached to the actuating member 6 and detached from the same without the need of tools. So, in one embodiment, the hand lever is attached to the actuating member 6 only when it is actually needed, but is detached when no manual switching operation is desired.

FIG. 5 in particular discloses that the driving member 5 comprises a base body 18 with a stopper area B1. FIG. 6 in particular discloses that the actuating member 6 comprises a base body 19 with an actuating area B2. FIGS. 7 and 8 disclose that the first locking member 8 comprises a base body 20 with a driver stopper area B3 and an actuator operating area B4. The stopper area B1 of the driving member 5 interacts with the driver stopper area B3 of the first locking member 8, and the actuating area B2 of the actuating member 6 interacts with the actuator operating area B4 of the first locking member 8. In this example, the first locking member 8 and the second locking member 9 are shaped identically. This is beneficial, but no mandatory condition.

The function of the actuating mechanism 2 and the arrangement 1 is explained hereinafter in more detail by use of the FIGS. 9 to 15, which each show a schematic top view of the actuating mechanism 2. Note that the locking spring 10 is omitted in FIGS. 9 to 15 so as to allow a better view on the actuating mechanism 2. Moreover, the load spring 7 is shown in a simplified way.

Figure 9:
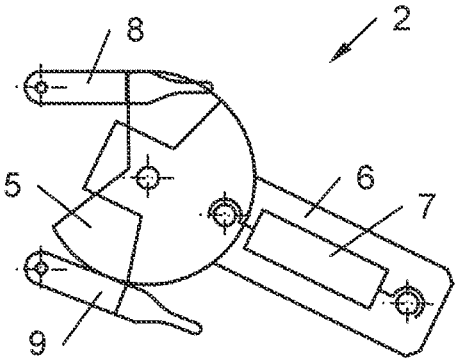
FIGS. 9-15 show various states of the actuating mechanism when it changes between its final states.

FIG. 9 basically corresponds to FIG. 4 and shows a first final state of the arrangement 1, in which the driving member 5 is in its first driver position and the actuating member 6 is its first actuator position and locked by the first locking member 8, which is in its locking position. That means that the stopper area B1 of the driving member 5 is in contact with the driver stopper area B3 of the first locking member 8. The second locking member 9 is in its release position.

Figure 10:
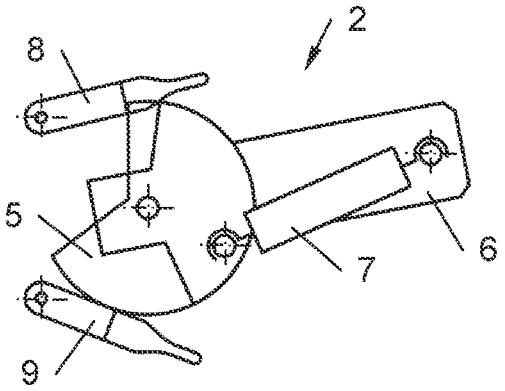

FIG. 10 shows an intermediate state, in which the actuating member 6 has been moved in counter clockwise direction. FIG. 10 indicates that the actuating member 6 has pushed out the first locking member 8 to some extent by interaction between the actuating area B2 of the actuating member 6 and the actuator operating area B4 of the first locking member 8, but nevertheless the driving member 5 is still blocked by the first locking member 8. In turn the load spring 7 is elongated and "loaded" or "charged" with mechanical energy.

Figure 11:
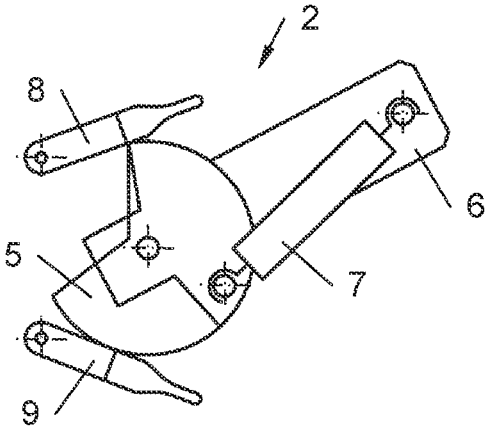

FIG. 11 shows an intermediate state, in which the actuating member 6 has been moved further in counter clockwise direction and has pushed out the first locking member 8 even further, too. Indeed, the first locking member 8 is at the edge of releasing the driving member 5, but the driving member 5 has not yet moved. The load spring 7 is elongated to its maximum in this state.

Figure 12:
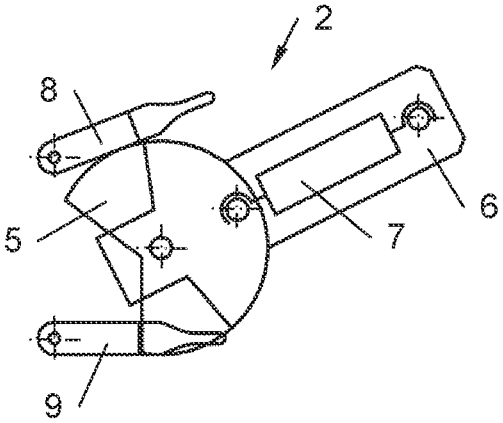

FIG. 12 shows a second final state of the arrangement 1. The driving member 5 has been released by the first locking member 8, has turned in counter clockwise direction and has reached its second driver position. Further on, the second locking member 9 has moved into its locking position and locks the driving member 5 in its second driver position. So, FIG. 12 shows a second final state of the arrangement 1, in which the driving member 5 is in its second driver position and the actuating member 6 is its second actuator position and locked by the second locking member 9, which is in its locking position. That means that the stopper area B1 of the driving member 5 is in contact with the driver stopper area B3 of the second locking member 9. The first locking member 8 is in its release position.

Hence, during a transition from the first final state to the second final state

- the load spring 7 is loaded upon a movement of the actuating member 6 towards its second position, wherein the driving member 5 is held in its first position by the first locking member 8 and wherein the first locking member 8 is moved into its release position by the actuating member 6 before or when the actuating member 6 reaches its second position,
- the driving member 5, caused by the force generated by the load spring 7, moves into its second position when the first locking member 8 moves into its release position and
- the second locking member 9 is moved into its locking position before or when the driving member 5 reaches its second position.

Figure 13:
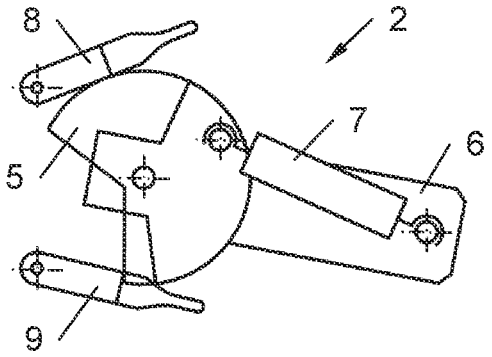
Figure 14:
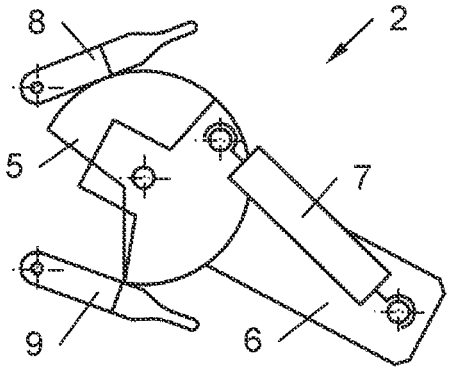
Figure 15:
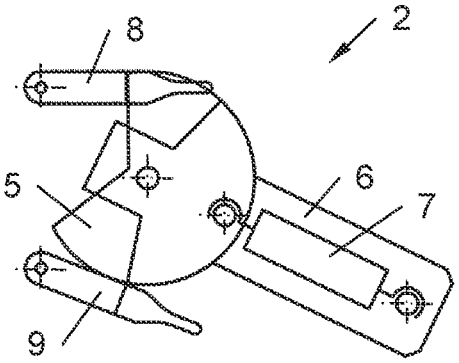

FIG. 13 to FIG. 15 now show the transition back to the first final state.

In detail, FIG. 13 shows an intermediate state, in which the actuating member 6 has been moved in clockwise direction. FIG. 13 indicates that the actuating member 6 has pushed out the second locking member 9 to some extent by interaction between the actuating area B2 of the actuating member 6 and the actuator operating area B4 of the second locking member 9, but nevertheless the driving member 5 is still blocked by the second locking member 9. In turn the load spring 7 is elongated and "loaded" or "charged" with mechanical energy again.

FIG. 14 shows an intermediate state, in which the actuating member 6 has been moved further in clockwise direction and has pushed out the second locking member 9 even further, too. Indeed, the second locking member 9 is at the edge of releasing the driving member 5, but the driving member 5 has not yet moved. The load spring 7 is elongated to its maximum in this state.

FIG. 15 again shows the first final state of the arrangement 1 and actually corresponds to FIG. 9. The driving member 5 has been released by the second locking member 9 and has turned in clockwise direction and even reached its first driver position. Further on, the first locking member 8 has moved into its locking position and locks the driving member 5 in its first driver position.

Hence, during a transition from the second final state to the first final state

- the load spring 7 is loaded upon a movement of the actuating member 6 towards its first position, wherein the driving member 5 is held in its second position by the second locking member 9 and wherein the second locking member 9 is moved into its release position by the actuating member 6 before or when the actuating member 6 reaches its first position,
- wherein the driving member 5, caused by the force generated by the load spring 7, moves into its first position when the second locking member 9 moves into its release position and
- wherein the first locking member 8 is moved into its locking position before or when the driving member 5 reaches its first position.

As is explicitly shown in FIGS. 1 and 2, the driving member 5 is mechanically linked to the electrical switching device 3 by the first linking member 11. So, a movement of the driving member 5 leads to a rotation of the transmission element 12 and via the push rod 13 to a movement of the movable switching member 14. The driver positions of the driving member 5 are linked to positions of the movable switching member 14 and hence to switching states of the electrical switching device 3. In one embodiment, the switching contacts of the electrical switching device 3 are in a first position or in an "on" position in the first driver position of the driving member 5 and are in a second position or in an "off" position in the second driver position of the driving member 5. In another embodiment, the switching contacts of the electrical switching device 3 are in a first position or in an "off" position in the first driver position of the driving member 5 and are in a second position or in an "on" position in the second driver position of the driving member 5.

By use of the actuating mechanism 2, the transition speed of the switching state of the electrical switching device 3 from "on" to "off" and/or from "off" to "on" is independent of the speed of the movement of the actuating member 6 and thus repeatable. It does not matter if the motor 16 moves fast or slow, and it does not matter if an operator manually moves the actuating member 6 fast or slow.

It should be noted at this point that the switching contacts of the electrical switching device 3 are not shown in the Figs., but the operation of an electrical switching device 3 is well known in prior art in principle. It should also be noted, that the proposed measures are not linked to the particular embodiment of the electrical switching device 3 as shown in the Figs., but a variety of electrical switching devices 3 can be driven by the actuating mechanism 2.

Figure 16:
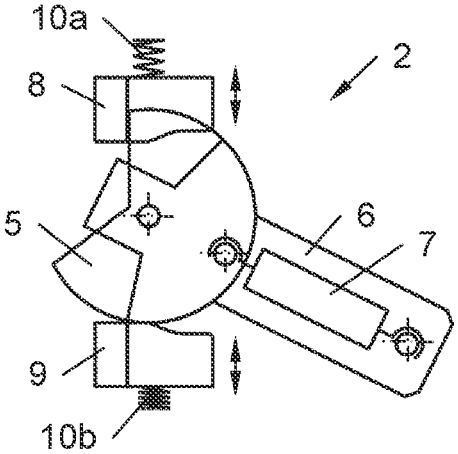
FIG. 16 shows an embodiment of the actuating mechanism with slidably mounted locking members.

In the examples shown in FIGS. 1 to 15, the first and the second locking member 9 are rotatable mounted to the frame 4 and forced into their locking position by a single locking spring 10 coupled to the first locking member 8 and the second locking member 9. However, this is not the only possibility. In an alternative embodiment, which is shown in FIG. 16, the first and the second locking member 9 are slidably mounted to the frame 4 and forced into their locking position by a first locking spring 10*a* coupled to the first locking member 8 and a second locking spring 10*b* coupled to the second locking member 9. Nevertheless, the function of such an actuating mechanism 2 is similar to that shown by way of FIGS. 9 to 15.

It is also possible that slidably mounted locking members 8, 9 are forced into their locking position by a single locking spring 10 coupled to the first locking member 8 and the second locking member 9, like this is the case for the embodiments FIGS. 9 to 15. On the other hand, it is also possible that rotatably mounted locking members 8, 9 are forced into their locking position by a first locking spring 10*a* coupled to the first locking member 8 and a second locking spring 10*b* coupled to the second locking member 9 like this is the case for the embodiment shown in FIG. 16.

Generally, a variety of elastic elements can be used to force the locking members 8, 9 into their locking position and to store energy for the switching action. Also, for example, the load spring 7 can be embodied as a tension spring as shown in the Figs., but can also embodied as a compression spring.

In the examples of FIGS. 1 to 16, the axis A1 of the driving member 5 coincides with the actuator axis A2 of the actuating member 6. Furthermore, the driving member 5, the actuating member 6 and the first and the second locking member 9 are symmetrically arranged around a symmetry line running through the axis A1 of the driving member 5 and a center point in the middle of the first and the second driver position. The symmetry line is a horizontal line through the axis A1 of the driving member 5 in the FIGS. 1 to 16. However, these are no necessary conditions, too. It is also imaginable that the axis A1 of the driving member 5 does not coincide with the actuator axis A2 of the actuating member 6 and/or that the driving member 5, the actuating member 6 and the first and the second locking member 8, 9 are not symmetrically arranged around a symmetry line. In this way, a different behavior of the actuating mechanism 2 can be achieved for the switching "on" operation and the switching "off" operation.

It is noted that the invention is not limited to the embodiments disclosed hereinbefore, but combinations of the different variants are possible. In reality, the actuating mechanism 2 and the arrangement 1 may have more or less parts than shown in the figures. Moreover, the description may comprise subject matter of further independent inventions.

It should also be noted that the term "comprising" does not exclude other elements and the use of articles "a" or "an" does not exclude a plurality. Also elements described in association with different embodiments may be combined. It should also be noted that reference signs in the claims should not be construed as limiting the scope of the claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 arrangement
2 actuating mechanism
3 electrical switching device
4 frame
5 driving member
6 actuating member
7 load spring
8 first locking member
9 second locking member
10, 10*a*, 10*b* locking spring
11 first linking member (rod)
12 transmission element
13 push rod
14 movable switching member (designed for linear movement)
15 static switching member
16 motor
17 second linking member
18 base body of driving member
19 base body of actuating member
20 base body of locking member
A1 axis of driving member
A2 axis of actuating member
A3 axis of first locking member
A4 axis of second locking member
A5 axis of transmission element
B1 stopper area of driving member
B2 actuating area of actuating member
B3 driver stopper area of locking member
B4 actuator operating area of locking member
P1 . . . P5 mounting points

What is claimed is:

1. An actuating mechanism for an electrical switching device, comprising:

a frame, a driving member, which is rotatably arranged in the frame around an axis and which is movable between a first driver position and a second driver position, wherein the driving member is mechanically linkable to the electrical switching device by a first linking member, wherein movable contacts of the electrical switching device are in a first position in the first driver position of the driving member and are in a second position in the second driver position of the driving member, an actuating member, which is rotatably arranged in the frame around an axis and which is movable between a first actuator position and a second actuator position by hand or by a motor, a load spring, which at its first end is mounted to a first mounting point on the driving member and mounted to a second mounting point on the actuating member, wherein the first mounting point is spaced apart from the axis of the driving member, and wherein the second mounting point is spaced apart from the axis of the actuating member, a first locking member and a second locking member, which are mounted to the frame, each being movable between a locking position and a release position, wherein in a first final state, the driving member is in its first driver position and the actuating member is its first actuator position and locked by the first locking member, which is in its locking position, wherein in a second final state the driving member is in its second driver position and the actuating member is its second actuator position and locked by the second locking member, which is in its locking position, wherein during a transition from the first final state to the second final state, the load spring is loaded upon a movement of the actuating member towards its second position, wherein the driving member is held in its first position by the first locking member and wherein the first locking member is moved into its release position by the actuating member before or when the actuating member reaches its second position, wherein the driving member, caused by the force generated by the load spring, moves into its second position when the first locking member moves into its release position, and wherein the second locking member is moved into its locking position before or when the driving member reaches its second position.

2. The actuating mechanism according to claim 1, wherein during a transition from the second final state to the first final state, the load spring is loaded upon a movement of the actuating member towards its first position, wherein the driving member is held in its second position by the second locking member and wherein the second locking member is moved into its release position by the actuating member before or when the actuating member reaches its first position, wherein the driving member, caused by the force generated by the load spring, moves into its first position when the second locking member moves into its release position, and wherein the first locking member is moved into its locking position before or when the driving member reaches its first position.

3. The actuating mechanism according to claim 1, wherein the load spring is embodied as a tension spring.

4. The actuating mechanism according to claim 1, wherein the first and the second locking member are rotatable mounted to the frame and forced into their locking position by a first locking spring coupled to the first locking member and a second locking spring coupled to the second locking member or by a single locking spring coupled to the first locking member and the second locking member.

5. The actuating mechanism according to claim 1, wherein the first and the second locking member are slidably mounted to the frame and forced into their locking position by a first locking spring coupled to the first locking member and a second locking spring coupled to the second locking member or by a single locking spring coupled to the first locking member and the second locking member.

6. The actuating mechanism according to claim 1, wherein the driving member, the actuating member and the first and the second locking member are symmetrically arranged around a symmetry line running through the axis of the driving member and a center point in the middle of the first and the second driver position.

7. The actuating mechanism according to claim 1, wherein the axis of the driving member coincides with the actuator axis of the actuating member.

8. An arrangement, comprising an electric switching device and the actuating mechanism according to claim 1, wherein the driving member is linked to the electric switching device by a first linking member.

9. The arrangement according to claim 8, wherein a motor is linked to the actuating member of the actuating mechanism by a second linking member.

10. The arrangement according to claim 8, wherein a hand lever is connected to the actuating member of the actuating mechanism or is part of the actuating member.

* * * * *